US011559131B1

(12) United States Patent
Blevins

(10) Patent No.: US 11,559,131 B1
(45) Date of Patent: Jan. 24, 2023

(54) MANUALLY OPERABLE CLIP HOLDER

(71) Applicant: Carolyn Blevins, Seal Beach, CA (US)

(72) Inventor: Carolyn Blevins, Seal Beach, CA (US)

( * ) Notice: Subject to any disclaimer, the term of this patent is extended or adjusted under 35 U.S.C. 154(b) by 0 days.

(21) Appl. No.: 17/459,793

(22) Filed: Aug. 27, 2021

(51) Int. Cl.
*A45F 5/02* (2006.01)
*A44B 6/00* (2006.01)

(52) U.S. Cl.
CPC ..... *A45F 5/02* (2013.01); *A44B 6/00* (2013.01); *A45F 2200/0575* (2013.01)

(58) Field of Classification Search
CPC .... A45F 5/02; A45F 2200/0575; A45F 5/021; Y10T 24/1394
See application file for complete search history.

(56) References Cited

U.S. PATENT DOCUMENTS 5,388,741 A * 2/1995 Hillinger ..... A45F 5/02 206/349
6,269,993 B1 * 8/2001 Ebejer ..... G01B 3/1071 224/269
7,117,566 B1 10/2006 Ewing
7,216,788 B2 * 5/2007 Blechman ..... B25H 3/006 224/269
9,173,475 B2 * 11/2015 Blechman ..... A45F 5/02
2008/0283563 A1 * 11/2008 O'Donnell ..... A45F 5/02 224/269
2020/0253364 A1 * 8/2020 Myers ..... B25H 3/006

* cited by examiner

*Primary Examiner* — Robert Sandy
(74) *Attorney, Agent, or Firm* — Morland C. Fischer

(57) ABSTRACT

A manually operable clip holder is disclosed to be attached to the clothing (e.g., at a belt or pants) worn by an individual to enable a tool to be carried from place-to-place by the individual while the individual's hands remain free. The clip holder has a casing that is capable of receiving, holding and releasing a clip that is connected to the tool to be carried by the individual. A flap pivotally coupled to the front of the casing rotates in response to a pushing force applied thereto in order to release the tool clip from the casing by way of an opening formed in the front. A flexible, U-shaped attachment clip is mounted on a metal clip retaining plate that is connected to the back of the casing. The U-shaped attachment clip is suspended from the clip retaining plate and configured to be removably attached to the individual's clothing.

10 Claims, 6 Drawing Sheets

MANUALLY OPERABLE CLIP HOLDER

BACKGROUND OF THE INVENTION

1. Field of the Invention

This invention relates to a manually operable clip holder adapted to receive, hold and release the clip of a tool so that the tool can be carried by an individual while the individual's hands remain free. The clip holder is removably attached to the clothing (e.g., at a belt or pants) worn by the individual by a flexible U-shaped clip that is mounted on a metal clip retaining plate connected to the back of the clip holder.

2. Background Art

From time-to-time, a workman may need to use a single tool to complete a job. In many cases, the tool is carried with other tools in a heavy and/or bulky tool kit. Whenever possible, the workman would prefer to avoid having to transport the tool kit to the job site when the use of a single tool from the kit is required. Moreover, the workman's hands may need to remain free at those times when the tool is not being used. Because of the tight space that is typically available to the workman and to avoid the possibility that the tool might fall out and cause injury or damage, it is preferable that the tool not be carried in the workman's pocket. In this regard, the tool should ideally be carried on the outside of the clothing of the workman at a location where the tool is readily accessible for use and easily returned when its use is no longer needed. Likewise, the means by which to attach the tool to the workman's clothing should be sufficiently reliable so that the tool will be held in place as the workman moves around the job site at which he may be exposed to vibrations and similar forces.

An example of a manually operable clip holder by which to enable a workman to carry a tool while having his hands remain free and which achieves the objectives listed above is available by referring to U.S. Pat. No. 7,117,566 issued Oct. 10, 2006. The patented clip holder is capable of receiving, holding and releasing a clip that is connected to the tool to be carried by the workman. However, what is now desirable is an improved means by which to enable this clip holder to be more easily and removably attached to the clothing of the workman.

SUMMARY OF THE INVENTION

In general terms, disclosed herein is a manually operable clip holder to be attached to the clothing (e.g., at a belt or pants) worn by an individual to enable a tool to be carried from place-to-place with the individual's hands remaining free. The clip holder is adapted to receive, hold and release a clip that is connected to the tool (e.g., a tape measure) to be carried by the individual. The clip holder has a casing with an opening at the front thereof. The tool clip is received through the opening to be retained within the casing of the clip holder. A flap is pivotally coupled to the front of the casing so as to be rotatable relative to the opening. The flap is responsive to a manual pushing force applied thereto so as to rotate from a first position at which to block the removal of the tool clip from the casing by way of the opening to a second position at which to permit the removal of the tool clip from the casing by way of the opening. A coiled spring is compressed between the flap and the back of the casing when the flap rotates from the first position to the second position so that the flap is urged to return to its first position when the pushing force is terminated and the spring expands.

A flexible attachment clip is mounted on a stainless steel clip retaining plate that is connected to the back of the casing of the clip holder. The attachment clip has a U-shape with a closed top and first and opposite free ends depending from the closed top between which a portion of the individual's clothing is slidably received. One of the first or second free ends of the U-shaped attachment clip is received through a first clip pass-through opening that is formed at the top of the clip retaining plate such that the attachment clip is suspended from its closed top. At the same time, the clip retaining plate is located between the first and opposite free ends of the attachment clip. Each of the first and opposite free ends of the U-shaped attachment clip has a bend formed therein. One of the bends is received through a second clip pass-through opening that is formed in the clip retaining plate below the first clip pass-through opening. The bends formed in the first and opposite ends of the U-shaped attachment clip are aligned to rotate towards and into engagement with one another to hold the attachment clip in place on the clip retaining plate and to retain the individual's clothing between the first and opposite free ends.

DESCRIPTION OF THE PREFERRED EMBODIMENT

Figure 1:
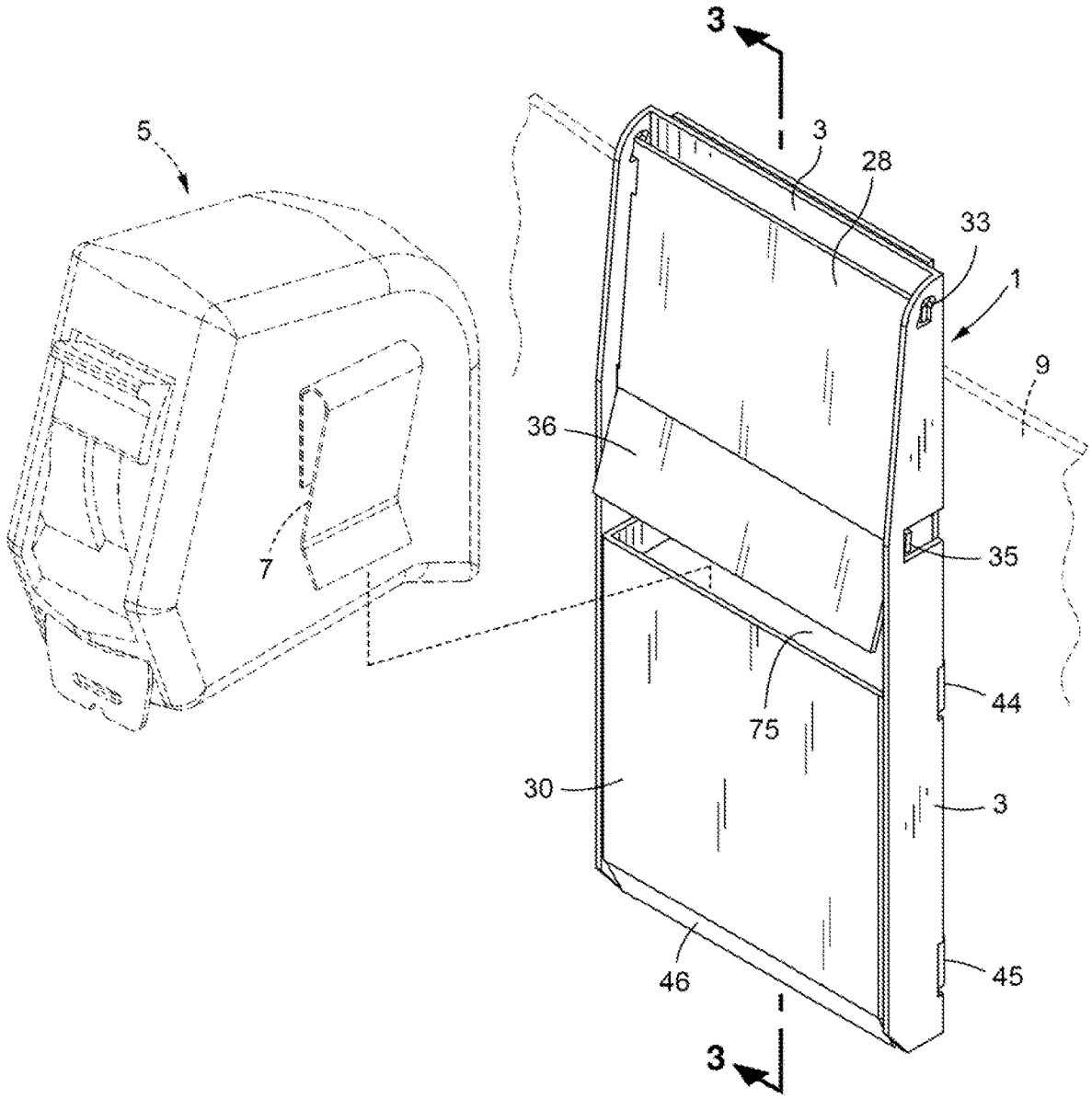
FIG. 1 is a front perspective view of a manually operable clip holder according to a preferred embodiment of this invention that is adapted to receive, hold and release the clip of a tool to be carried by the clip holder and be removable attached to the clothing worn by an individual.
Figure 2:
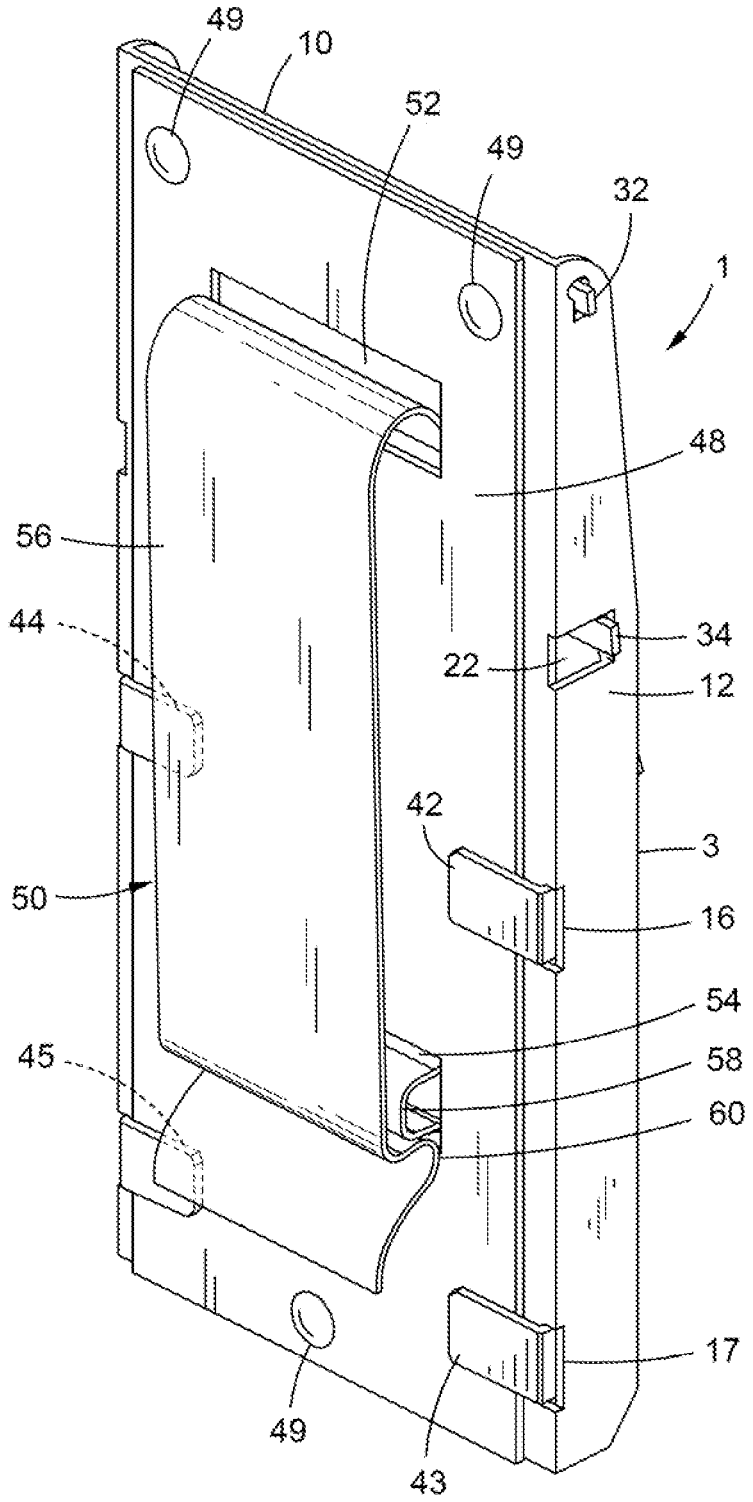
FIG. 2 is a rear perspective view of the manually operable clip holder shown in FIG. 1.

An easy to attach and easy to use manually operable clip holder 1 is disclosed while referring initially to FIGS. 1 and 2 of the drawings. The clip holder includes a casing 3 that is manufactured from sheet stainless steel or any other suitable durable material. As will be described in greater detail hereinafter, a small hand tool is coupled to the casing 3 to be conveniently carried by the clip holder 1. By way of example only, one suitable tool that can be coupled to the casing 3 and carried by the clip holder 1 is a measuring tape dispenser (shown in phantom lines in FIG. 1 and designated by the reference numeral 5). The tool 5 has a tool clip 7 that is releasably attached to the front of the clip holder 1. As shown in FIG. 2, the back of the casing 3 has a flexible attachment clip 50 connected thereto by which the clip holder 1 and the tool 5 coupled thereto are attached to the clothing of an individual, such as at a belt or pants (designated 9 in FIG. 1), so that the tool 5 can be transported without requiring the individual to use his hands.

Figure 3:
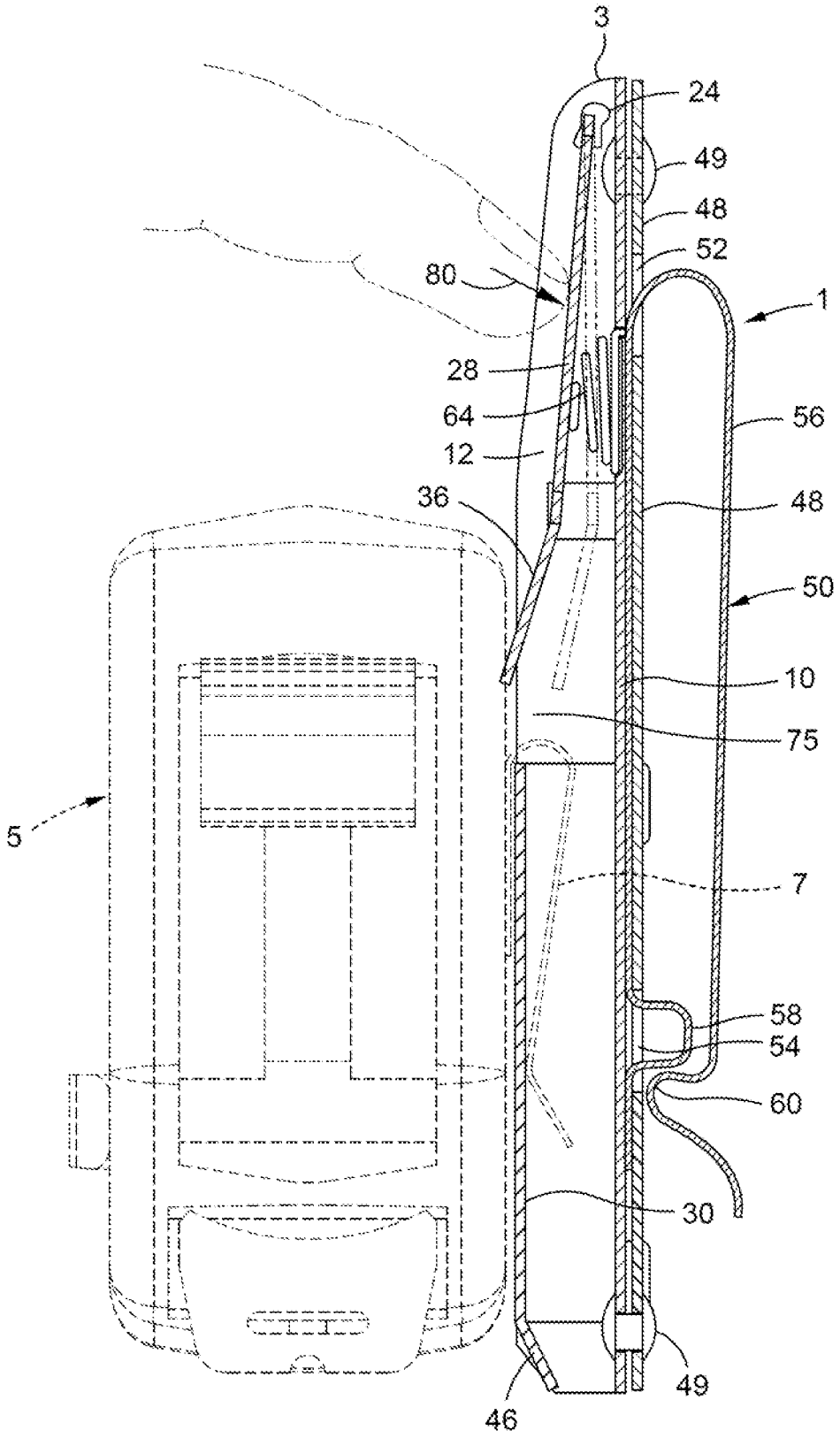
FIG. 3 is a cross-section of the manually operable clip holder taken along lines 3-3 of FIG. 1 with the tool clip attached to the clip holder and the clip holder attached to the individual's clothing.
Figure 4:
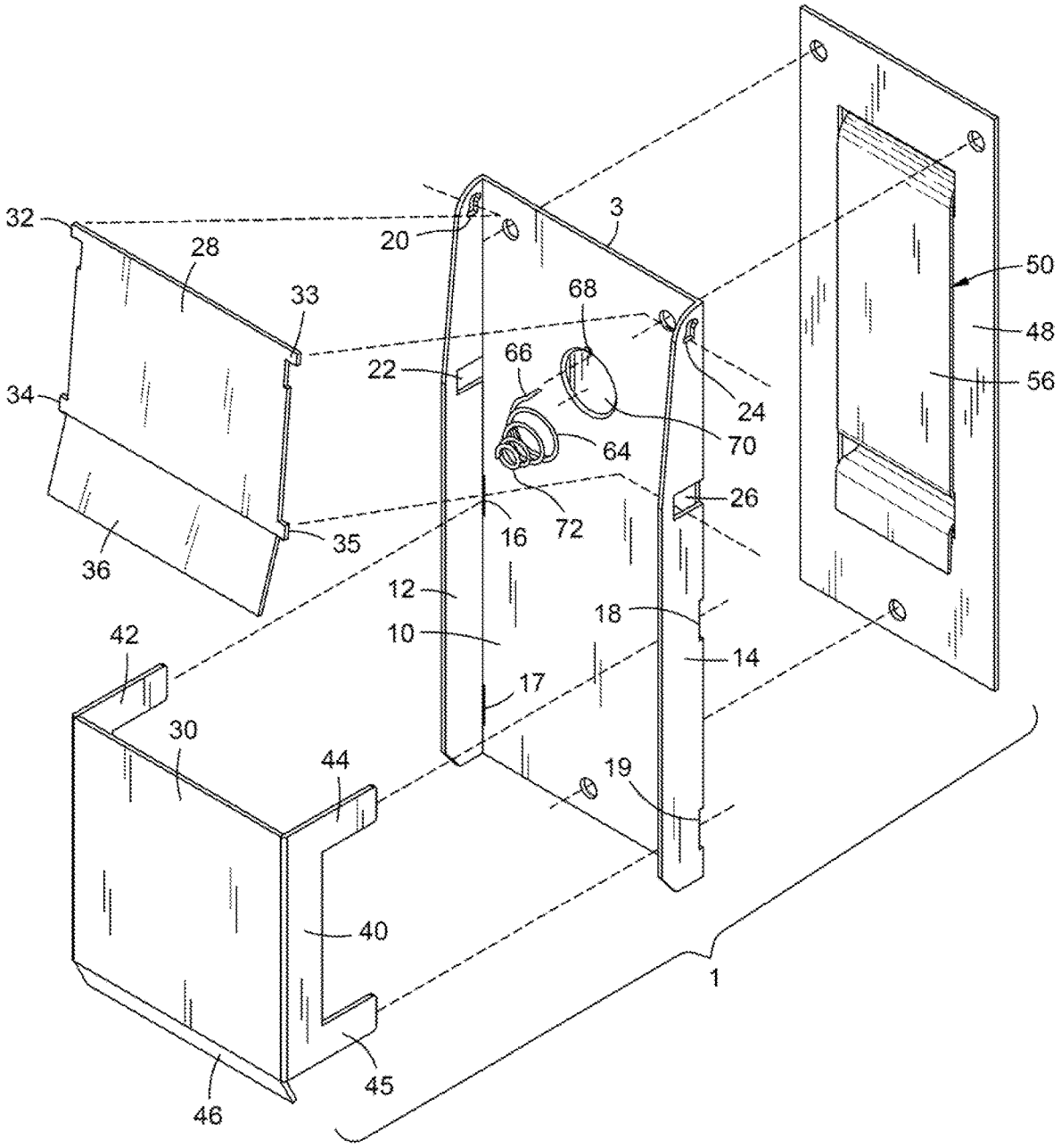
FIG. 4 is a front exploded view of the manually operable clip holder shown in FIG. 1.
Figure 5:
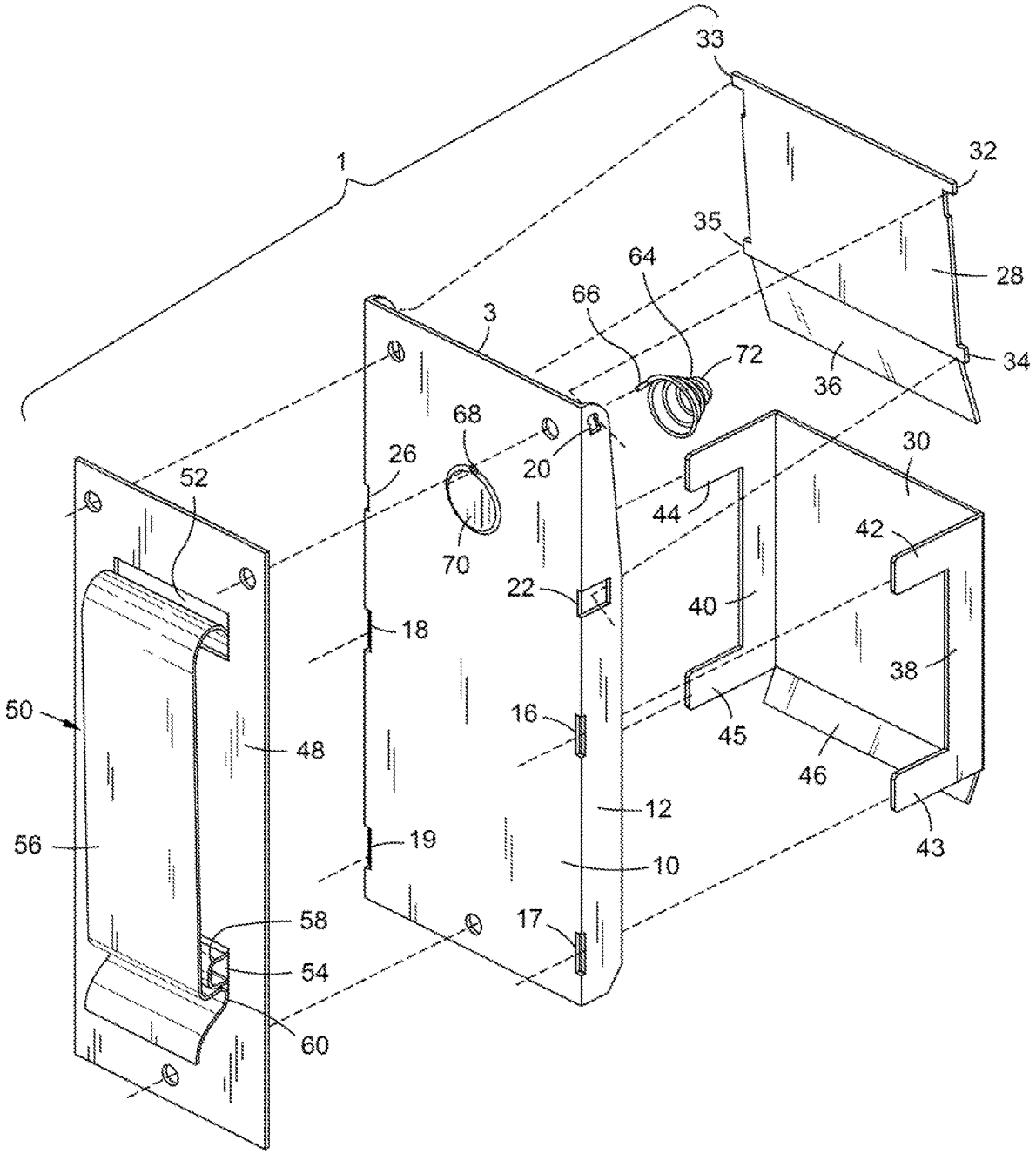
FIG. 5 is a rear exploded view of the manually operable clip holder shown in FIG. 2.

Details of the manually operable clip holder 1 are now disclosed while referring concurrently to FIGS. 1-7 of the drawings. As is best shown in FIG. 4, the casing 3 of the clip holder 1 includes a back wall 10 that runs the length of the clip holder. Outside edges of the back wall 10 are bent forwards to create opposing first and second side walls 12 and 14 for the casing 3. As is best shown in FIG. 5, a first pair of connection slots 16 and 17 are formed through the casing 3 to lie one above the other at the intersection of the back wall 10 with a first side wall 12. A second pair of connection slots 18 and 19 are also formed through the casing 3 to lie one above the other at the intersection of the back wall 10 and the second side wall 14.

As is also best shown in FIGS. 4 and 5, a first pivot coupling slot 20 is formed through the top of the first side wall 12 of the casing 3. A first guide track 22 is formed through the first side wall 12 below the first pivot coupling slot 20. The first pivot coupling slot 20 and the first guide track 22 formed through the first side wall 12 lie above the first pair of connection slots 16 and 17. A second pivot coupling slot 24 is formed through the top of the second (i.e., opposite) side wall 14 of the casing 3. A second guide track 26 is formed through the second side wall 14 below the second pivot coupling slot 24. The second pivot coupling slot 24 and the second guide track 26 formed through the second side wall 14 lie above the second pair of connection slots 18 and 19.

Located at the front of the casing 3 of the manually operable clip holder 3 opposite the back wall 10 thereof are a rotatable flap 28 and an upstanding front wall 30 that are aligned vertically one above the other. The rotatable flap 28 has a first pair of tabs 32 and 33 extending outwardly from the top and opposite sides thereof and a second pair of tabs 34 and 35 extending outwardly from the opposite sides thereof below the first pair of tabs 32 and 33 near the bottom of the flap 28. The bottom of the rotatable flap 28 lying below the tabs 34 and 35 is bent slightly forwards to establish a skirt 36 and a pushing surface against which a finger or thumb pressure can be applied for an advantage that will be described hereinafter.

Each of the opposite sides of the front wall 30 of the casing 3 is bent back by 90 degrees to create rearwardly extending first and second side walls 38 and 40. Extending rearwardly from the top and bottom of the first side wall 38 of the front plate 30 are a first pair of locking fingers 42 and 43. Extending rearwardly from the top and bottom of the second (i.e., opposite) side wall 40 are a second pair of locking fingers 44 and 45. The bottom of the front wall 30 of the casing 3 that lies below the first and second side walls 38 and 40 is bent slightly towards the back wall 10 to create a closure 46. The back wall 10 and the front wall 30 of the casing 3 are spaced from one another in a manner that will now be described.

In this regard, and as is best shown in FIGS. 1, 4 and 5, the rotatable flap 28 is pivotally connected to the top and front of the casing 3 of the clip holder 1, and the front wall 30 is fixedly connected to the bottom and front of casing 10 below flap 28 and the skirt 36 depending therefrom. More particularly, the tabs 32 and 33 at the top and opposite sides of the rotatable flap 28 are received within respective pivot coupling slots 20 and 24 formed in the first and second side walls 12 and 14 of the casing 3 by which to establish a pivot axis at which the rotatable flap 28 can rotate back and forth within casing 3 towards and away from the back wall 10 thereof in response to the finger or thumb pressure to be applied thereto.

Likewise, the tabs 34 and 35 located near the bottom and at opposite sides of the rotatable flap 28 are received within respective guide tracks 22 and 26 that are formed in the first and second side walls 12 and 14 of the casing 3. The tabs 34 and 35 are adapted to ride back and forth through guide tracks 22 and 26 to control the path of and stabilize the flap 28 as it rotates back and forth within the casing 3 in response to the aforementioned finger or thumb pressure to be applied thereto.

The upstanding front wall 30 is connected to the casing 3 by pushing the first and second pairs of locking fingers 42, 43 and 44, 45 which extend rearwardly from the front wall 30 through respective ones of first and second pairs of connection slots 16, 17 and 18, 19 that are formed in the casing 3. As is best shown in FIG. 2, the locking fingers 42-45 are then bent by about 90 degrees behind the casing 3 to hold the front wall 30 in place connected to the casing 3 and spaced from the back wall 10. With the clip holder 1 in its assembled configuration shown in FIGS. 1 and 2, and the rotatable flap 28 and the front wall 30 lying in vertical alignment one above the other, the forwardly bent pushing skirt 36 that depends from the bottom of the rotatable flap 28 is located slightly above the top of the front wall 30 so that a tool clip entry space (designated 75 in FIGS. 1 and 3) is created therebetween.

Figure 6:
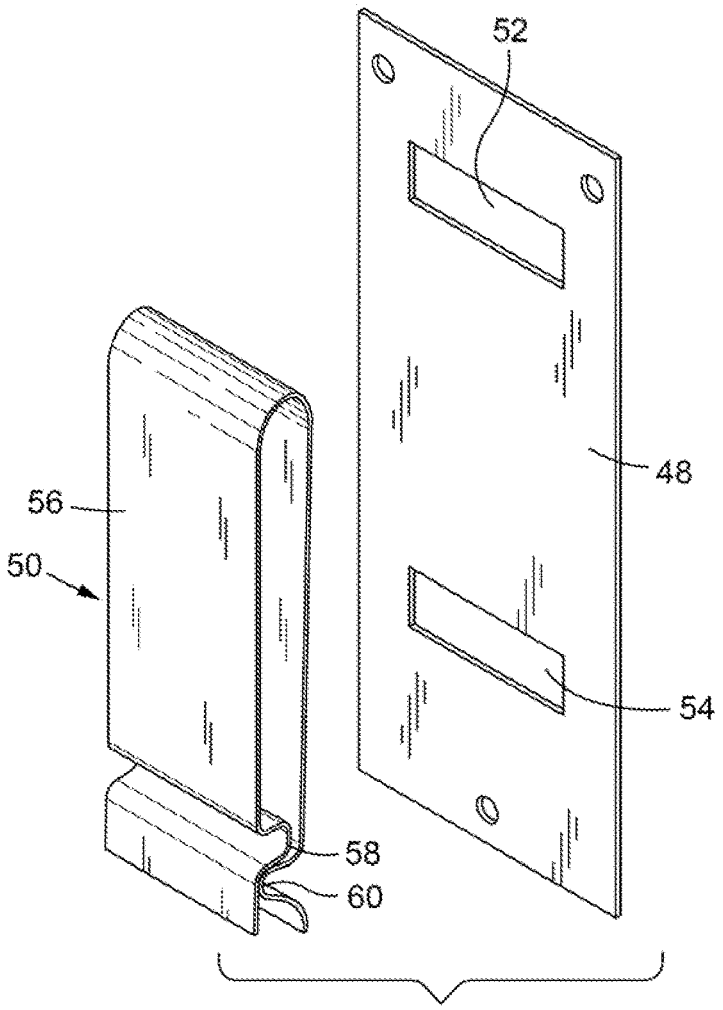
FIG. 6 is an exploded view showing a clip retaining plate and a flexible, U-shaped clip to be mounted on and suspended from the clip retaining plate.
Figure 7:
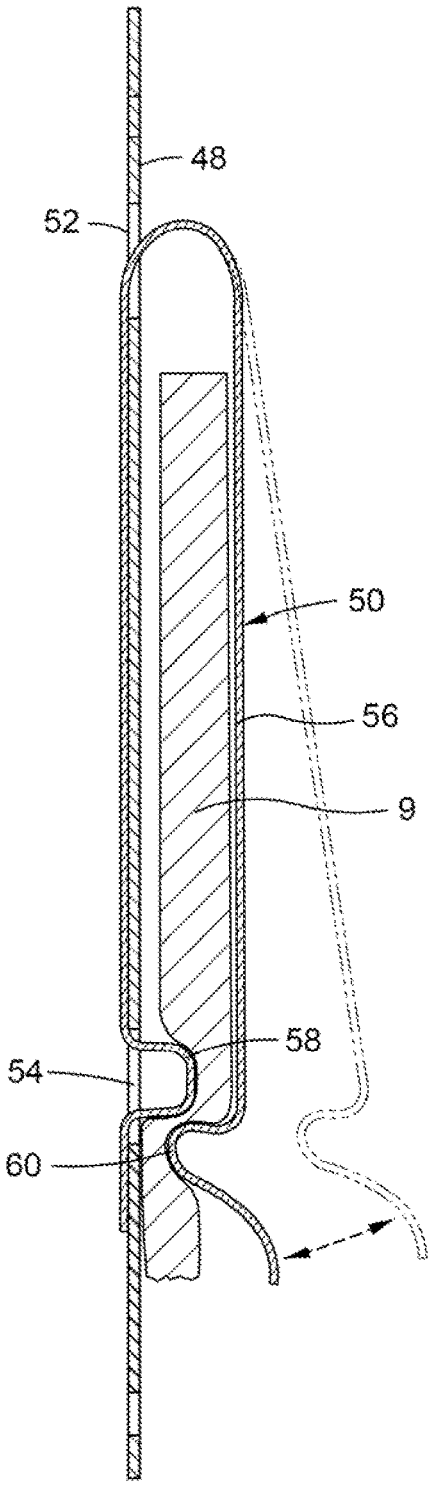
FIG. 7 shows the U-shaped clip of FIG. 6 mounted on and suspended from the clip retaining plate with the clip retaining plate connected to the back of the manually operable clip holder.

Turning briefly to FIGS. 5-7, a stainless steel clip retaining plate 48 to which a flexible stainless steel clip 50 is attached is shown to be connected by means of fasteners (e.g., rivets 49 in FIGS. 2 and 3) to the rear of the back wall 10 of the casing 3 of the manually operable clip holder 1. The clip retaining plate 48 has top and bottom clip pass-through openings 52 and 54 formed therein and lying one above the other. The flexible clip 50 has a generally U-shaped body 56 with a closed top and first and opposite free ends depending therefrom. An upper mounting bend 58 turns in a first direction from the first free end of the U-shaped body 56 of the clip 50. A lower locking bend 60 turns in an opposite direction towards the upper mounting bend 58 from the opposite free end of the U-shaped body 56. The upper and lower mounting and locking bends 58 and 60 are positioned one above the other so as to be aligned to rotate towards and into engagement with one another when the flexible clip 50 is attached to the casing 3.

As is best shown in FIG. 7, the flexible clip 50 is attached to the clip retaining plate 48 by moving the U-shaped clip body 56 through the top clip pass-through opening 52 formed in the plate 48 such that the clip 50 is suspended downwardly from the top of plate 48 at opening 52. The upper mounting bend 58 at the first free end of the clip body 56 is received through the bottom clip pass-through opening 54 of the clip retaining plate 48 to hold the flexible clip 50 in place attached to plate 48. When the clip holder 1 is removably attached to the clothing of the individual in the manner shown in FIG. 3 so that the tool 5 is carried hands free by the individual, the lower locking bend 60 at the opposite free end of the clip body 56 is rotatable at the closed top of the flexible clip 50 towards and into engagement with the upper mounting bend 58 to hold the clip 50 closed with the clip retaining plate 48 located between the free ends of clip 50 and with the individual's clothing (designated 9 in FIG. 3) securely retained between the upper and lower mounting and locking bends 58 and 60. By virtue of its flexible nature, and as is also best shown in FIG. 7, the U-shaped clip 50 may be pulled open (as represented by phantom lines) so that the lower locking bend 60 is rotated out of its engagement with the upper mounting bend 58 to enable the clip holder 1 to be separated from the clothing of the individual.

As an advantage provided by this invention and as is best shown in FIGS. 3-5, a spring (e.g., a coiled spring) 64 is located between the back wall 10 of the casing 3 and the rotatable flap 28 that is pivotally connected to the top and side walls 12 and 14 of the casing 3. A first end 66 of the spring 64 is connected to the casing 3 at a hole 68 formed in the back wall 10. In the case of a coiled spring, the first end 66 of spring 64 includes a winding that lies within a small circular recess or depression 70 that is formed in the back wall 10 of the casing 3, and the opposite end 72 of the coiled spring 64 includes a winding that presses against the rotatable flap 28.

When the manually operable clip holder 1 of this invention is removably attached to the clothing of an individual (such as at the individual's belt or pants 9 shown in FIGS. 1 and 3) and prior to a tool (such as that designated 5 in FIGS. 1 and 3) being coupled to the clip holder, the spring 64 lying between the back wall 10 of the casing 3 and the rotatable flap 28 is relaxed and expanded. The expanded spring 64 causes the rotatable flap 28 and the pushing skirt 36 depending therefrom to rotate away from the back wall 10 of the casing 3. The individual may now couple the tool 5 to the clip holder 1 by moving the clip 7 of tool 5 into the clip entry space 75 for receipt between the front plate 30 and back wall 10 of the casing 3. At the same time, the tool clip 7 slides downwardly over the top and along the sides of the front plate 30 (best shown in FIG. 3). The pushing skirt 36 that bends forwardly from the bottom of the rotatable flap 28 is positioned to block the unintentional removal of the tool clip 7 through the clip entry space 75 and thereby prevent a separation of the tool 5 from the clip holder 1.

As is also best shown in FIG. 3, should the individual wish to release the tool clip 7 from the front plate 30 and remove the tool 5 from the clip holder 1, a finger or thumb pushing force is applied to either the rotatable flap 28 (as shown) or to the pushing skirt 36 in the direction of the reference arrow 80. Accordingly, the rotatable flap 28 is caused to rotate at its tabs (designated 32 and 33 in FIGS. 4 and 5) that are pivotally coupled to the pivot coupling slots 20 and 24 formed in the side walls 12 and 14 of the casing 3, whereby the spring is compressed against the back wall 10 of the casing. Both the rotatable flap 28 and the pushing skirt 36 depending therefrom are now rotated towards the back wall 10 as represented by the phantom lines in FIG. 3. With the pushing skirt 36 moved out of its way, the clip 7 of the tool 5 can now be lifted upwardly and off the front plate 30 to be removed from the clip holder 1 by way of the clip entry space 75, whereby the tool 5 is separated from the clip holder.

When the pushing force being applied to the rotatable flap 28 or pushing skirt 36 is terminated, the spring 64 will be permitted to expand and thereby urge the rotatable flap 28 and the pushing skirt 36 to rotate in an opposite direction towards the clip entry space 75 so that the clip from the same or a different tool can be removably attached to the manually operable clip holder 1 in the manner just described. In the meantime, the U-shaped clip 50 can be pulled upwardly and off the individual's clothing to separate the tool 5 from the individual.

The invention claimed is:

1. A clip holder to be carried on clothing worn by an individual for receiving, holding and releasing a tool clip, said clip holder comprising:

a casing having a front and a back;

the front of said casing having an opening for the removable receipt therethrough of said tool clip and a flap coupled to the front of said casing and being movable relative to said opening from a first position at which to block the removal of said tool clip from said casing by way of said opening to a second position at which to permit the removal of said tool clip from said casing by way of said opening; and the back of said casing having a clip retaining plate connected thereto and an attachment clip coupled to said casing at said clip retaining plate, said attachment clip being configured to be attached to the clothing of the individual, whereby said clip holder is carried by the individual, said attachment clip having a U-shape with a closed top and first and opposite free ends depending from said closed top, and said clip, retaining plate to which said U-shaped attachment clip is coupled having a first clip pass-through opening formed therein, said U-shaped attachment clip being received through the first clip pass-through opening of said clip retaining plate such that said U-shaped attachment clip is suspended from said closed top thereof at said first clip pass-through opening and said clip retaining plate is located between the first and opposite ends of said U-shaped attachment clip.

2. The clip holder recited in claim 1, wherein said U-shaped attachment clip is flexible, such that at least one of said first or opposite free ends thereof is adapted to bend at said closed top and rotate towards and away from the other one of said first or opposite free ends.

3. The clip holder recited in claim 1, wherein each of the first and the opposite free ends of said U-shaped attachment clip has a bend formed therein, the bends of said first and opposite free ends being aligned to be rotated towards and into engagement with one another so that said first and opposite free ends are held together at said bends.

4. The clip holder recited in claim 2, wherein said clip retaining plate also has a second clip pass-through opening formed therein and lying below said first clip pass-through opening, one of the bends formed in the first and opposite free ends of said U-shaped attachment clip being received through said second clip pass-through opening so as to be aligned with and rotated towards and into engagement with the bend of the other one of said first and opposite free ends so as to hold said U-shaped attachment clip in place on said clip retaining plate and retain the clothing of the individual at which said clip holder is carried between said first and opposite ends.

5. The clip holder recited in claim 1, wherein the flap coupled to the front of said casing is pivotally connected to said casing so as to be rotatable relative to the opening at the front of said casing between said first and second positions.

6. The clip holder recited in claim 5, further comprising a spring located between said flap and the back of said casing, said flap being responsive to a manual pushing force applied thereto for causing said flap to rotate towards the back of said casing from said first position to said second position and said spring to be compressed by which to permit said tool clip to be removed from said casing by way of the opening at the front of said casing.

7. The clip holder recited in claim 6, wherein said spring is a coiled spring having a first coiled end connected to the back of said casing and an opposite coiled end lying against said flap such that said coiled spring is compressed between said flap and the back of said casing when said flap rotates towards the back of said casing in response to the pushing force applied to said flap.

8. The clip holder recited in claim 7, wherein the back of said casing has a recess formed therein, and the first coiled end of said coiled spring being connected to the back of said casing and received within said recess.

9. A clip holder to be carried on clothing worn by an individual for receiving, holding and releasing a tool clip, said clip holder comprising:

a casing having a front and a back;

the front of said casing having an opening for the removable receipt therethrough of said tool clip and a flap pivotally connected to the front of said casing and being rotatable relative to said opening between a first position at which to block the removal of said tool clip from said casing by way of said opening and a second position at which to permit the removal of said tool clip from said casing by way of said opening, and the back of said casing having a recess formed therein and a clip retaining plate connected thereto;

an attachment clip coupled to said casing at said clip retaining plate, said attachment clip being configured to be attached to the clothing of the individual, whereby said clip holder is carried by the individual; and a spring located between said flap and the back of said casing, said flap being responsive to a manual pushing force applied thereto for causing said flap to rotate towards the back of said casing from said first position to said second position and said spring to be compressed by which to permit said tool clip to be removed from said casing by way of the opening at the front of said casing, said spring having a first end connected to the back of said casing within the recess formed in said back and an opposite end lying against said flap such that said spring is compressed between said flap and the back of said casing when said flap rotates towards the back of said casing in response to the pushing force applied to said flap.

10. The clip holder recited in claim 9, wherein said spring is a coiled spring, and the first end of said spring is a coil that is received within the recess formed in the back of said casing.

* * * * *